United States Patent [19]

Hentschel

[11] Patent Number: 4,744,425

[45] Date of Patent: May 17, 1988

[54] APPARATUS FOR EXCAVATING A SUBSTANTIALLY VERTICAL SLOT

[75] Inventor: Volker Hentschel, Dorsten, Fed. Rep. of Germany

[73] Assignee: Hochtief Aktiengesellschaft Vorm. Gebr. Helfmann, Essen, Fed. Rep. of Germany

[21] Appl. No.: 6,764

[22] Filed: Jan. 27, 1987

[30] Foreign Application Priority Data

Jan. 28, 1986 [DE] Fed. Rep. of Germany ..... 3602387

[51] Int. Cl.[4] ..... E21B 7/08

[52] U.S. Cl. ..... 175/73; 175/94; 299/75

[58] Field of Search ..... 299/31, 70, 73, 75; 175/94, 101, 106, 61, 74, 73, 319

[56] References Cited

U.S. PATENT DOCUMENTS

| | | | |
|---|---|---|---|
| 3,743,034 | 7/1973 | Bradley | 175/61 |
| 4,420,188 | 12/1983 | Robbins et al. | 299/31 |
| 4,548,443 | 10/1985 | Turner | 299/31 |
| 4,655,493 | 4/1987 | Sumi | 299/31 X |

FOREIGN PATENT DOCUMENTS

| | | | |
|---|---|---|---|
| 0109907 | 5/1984 | European Pat. Off. . | |
| 1534611 | 8/1969 | Fed. Rep. of Germany | 299/31 |
| 3239684 | 5/1984 | Fed. Rep. of Germany | 175/74 |

*Primary Examiner*—James A. Leppink
*Assistant Examiner*—Hoang C. Dang
*Attorney, Agent, or Firm*—Karl F. Ross; Herbert Dubno

[57] ABSTRACT

The apparatus for making a substantially vertical slot in the ground, especially in a single operation in making a sealing or supporting wall, comprises a machine frame with a rectangular cross section guided in the slot in the ground with a plurality of guide surfaces and at least one driven cutting wheel positioned at the lower end of the machine frame. The machine frame and the cutting wheels have a width which correspond to the width of the slot in the ground within tolerances defined by the guide free play and the cutting free play. The machine frame is guided in the vertical slot with a plurality of guiding surfaces and comprises an upper guide frame and a lower guide frame. The cutting wheels are mounted on the lower guide frame. The controlling piston cylinder unit for control of the lower guiding frame is mounted between the upper and lower guiding frames. This controlling piston cylinder unit comprises four pair of controlling piston cylinder devices which are positioned in four inclined planes so that the lower guide frame opposing the upper guide frame is pivotable not only according to two mutually crossing degrees of freedom but also about a vertical axis.

2 Claims, 2 Drawing Sheets

APPARATUS FOR EXCAVATING A SUBSTANTIALLY VERTICAL SLOT

FIELD OF THE INVENTION

My present invention relates to an excavator for making a substantially vertical slot in the ground, particularly as a step in making a sealing and/or supporting wall.

BACKGROUND OF THE INVENTION

An apparatus for sinking a substantially vertical slot in the ground in a single operation or step in making a sealing or supporting wall, e.g. for diverse mining applications, can comprise a machine frame with a rectangular cross section guided in the slot in the ground with a plurality of guide surfaces and at least one driven cutting wheel positioned at the lower end of the machine frame. An example of this apparatus is described in European Patent application No. 0 109 907 published 30 May 1984.

The machine frame comprises an upper guide frame and a lower guide frame. The cutting wheels are mounted on the lower guide frame. A controlling piston-cylinder unit is positioned on the upper guide frame. The unit provides steering control of the lower guide frame about two mutually crossing axes. These axes define respective degrees of freedom which coincide with the axes of the machine frame cross section.

The lower guide frame has a plate which is connected to the opposing plate of the upper guide frame. However, the mounting is accomplished by a resilient member.

The piston-and-cylinder devices are so mounted that the lower guide frame opposing the upper guide frame has two superimposed pivotal degrees of freedom, i.e. it is pivotable about two mutually perpendicular, normally horizontal, axes. However, rotation of the tool about a vertical axis is not possible. Inspite of the described allowed pivotal degrees of freedom, forces can occur in the known device which, especially for large depths, cause deviations from the proper wall alignment or the vertical orientation or plumbness of the slot in the ground. Also, pivoting is not easy in the direction of slot propagation in the ground.

OBJECTS OF THE INVENTION

It is an object of my invention to provide an improved apparatus for making a substantially vertical slot in the ground, particularly for making a sealing or supporting wall, which avoids the aforementioned drawbacks.

It is another object of my invention to provide an improved apparatus for making a substantially vertical slot in the ground, particularly for making a sealing or supporting wall, with which the slot in the ground can be made more accurately vertical or plumb to a greater depth than previously.

It is yet another object of my invention to provide an improved apparatus for excavating a substantially vertical slot in the ground, particularly for making a sealing or supporting wall, with which the slot in the ground can be made with walls which are more accurately aligned than previously.

SUMMARY OF THE INVENTION

These objects and others which will become more readily apparent hereinafter are attained in accordance with my invention in an apparatus for making a substantially vertical slot in the ground, particularly in a single operation in making a sealing or supporting wall, comprising a machine frame with a rectangular cross section guided in the slot in the ground with a plurality of guide surfaces and at least one driven cutting wheel positioned at the lower end of the machine frame.

The machine frame comprises an upper guide frame and a lower guide frame, the cutting wheels being mounted on the lower guide frame. A controlling piston-and-cylinder unit is positioned on the upper guide frame. The unit provides for control of the lower guide frame with respect to two mutually crossing axes. These axes define two degrees of freedom which coincide with the axes of the machine frame cross section.

According to my invention the guide frame is suspended with the help of a plurality of pivot rods and corresponding pivots (e.g. universal or cardan joints) under the upper guide frame. The controlling piston-and-cylinder unit comprises four pairs of controlling piston-and-cylinder devices. These devices are positioned in four inclined planes so that the lower guide frame opposing the upper guide frame is not only pivotable according to both of the mutually crossing degrees of freedom but also is rotatable limitedly about a vertical axis relative to the upper frame.

The advantage of the additional degree of freedom, which allows the rotation of the lower guide frame about the vertical axis of the system, is that it permits a very accurate wall alignment. Furthermore, pivoting is made easier in the direction of the slot in the ground.

According to another aspect of the invention, the apparatus comprises an upper member of generally vertically elongated, horizontally narrow, rectangular parallelopipedal configuration adapted to be lowered into the ground. Spaced directly below the upper member is a lower member of rectangular parallelopipedal configuration with a horizontal cross section corresponding to that of the upper member.

A plurality of substantially inextensible links connect the upper member with the lower member. These links are swivably joined at the ends of the links with the members to permit angular displacement of the lower member relative to the upper member about a vertical axis of the members. Angular displacement is also rendered about two substantially horizontal mutually perpendicular axes corresponding to longitudinal and transverse axes of the cross section. The vertical axis and the longitudinal axis define a longitudinal median plane through the members. Further, the vertical axis and the transverse axis define a transverse median plane through the members.

According to the invention at least two hydraulic piston-and-cylinder units are symmetrically inclined to the transverse median plane and connected by ball joints to the upper and lower members. At least two pairs of hydraulic piston-and-cylinder units are disposed symmetrically on opposite sides of the transverse median plane but symmetrically inclined to the longitudinal median plane and connected by ball joints to the upper and lower members. Means are also provided for controlling the piston-and-cylinder units for displacement of the lower member about the axes. The apparatus also includes at least one cutting wheel on the lower member drivable to cut the slot into the ground.

Preferably the piston-and-cylinder units, symmetrically inclined to the transverse median plane, are provided in respective pairs. Four of the inextensible links are provided at respective corners of the horizontal section through the apparatus.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
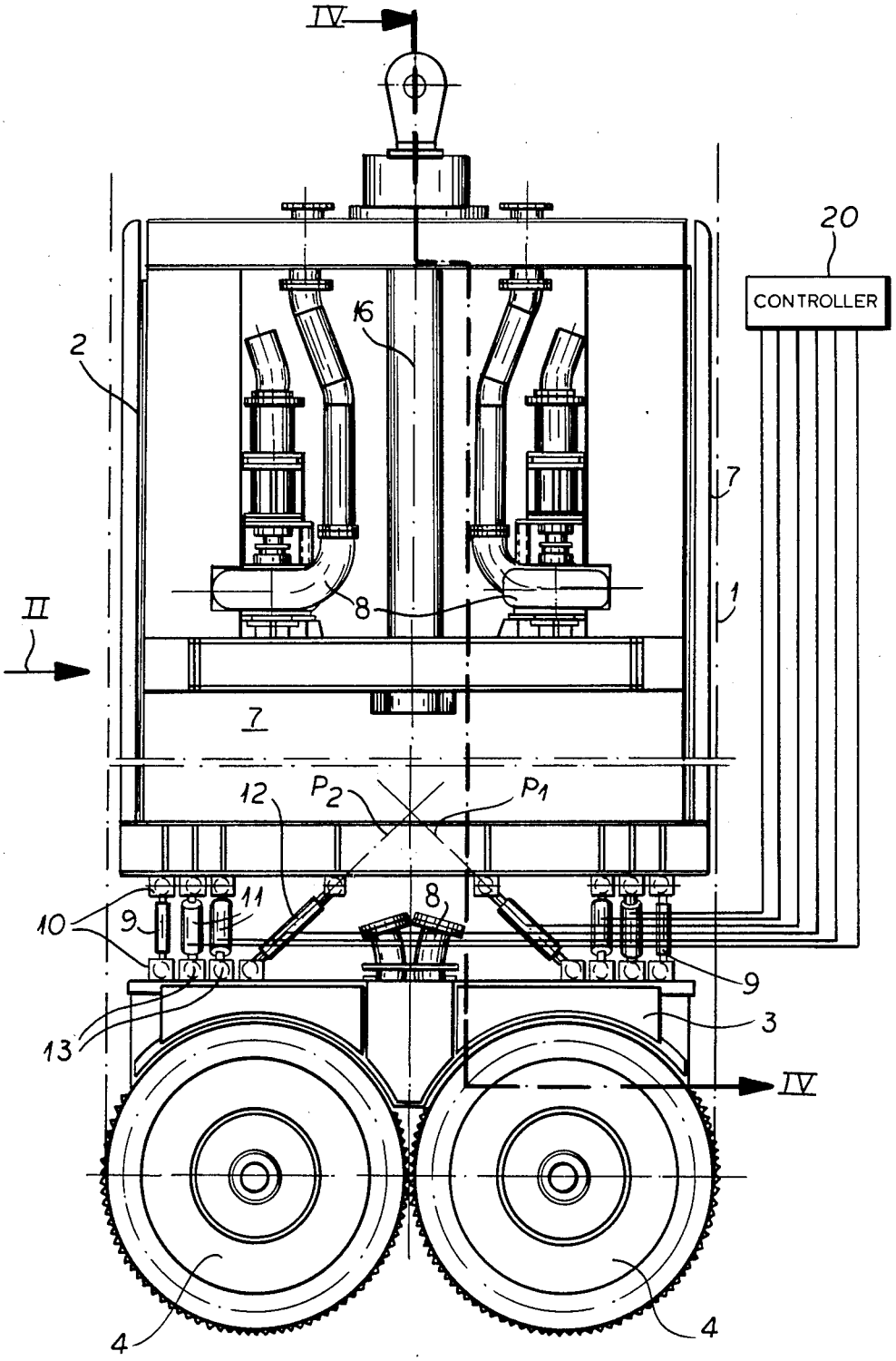
FIG. 1 is a schematic side elevational view of an apparatus for making a substantially vertical slot in the ground or earth according to my invention.

The apparatus shown in the drawing is used to excavate a substantially vertical slot 1 in the earth or ground in a single operation in making a sealing or supporting wall, e.g. in mining applications.

This apparatus comprises a machine frame 2,3 and at least one driven cutting wheel 4 positioned at the lower end of the machine frame 2, 3.

Advantageously two cutting wheels 4 are provided each of which is assembled from two cutting rolls 5 and a central support and drive body 6.

The machine frame 2, 3 has a rectangular cross section. The machine frame 2, 3 and the cutting wheels 4 have a width which corresponds to the width of the excavated slot 1 to tolerances within a play due to guidance and a play due to cutting.

The machine frame 2, 3 is guided with guiding surfaces 7 engageable with the vertical wall slot 1.

The machine is provided with devices generally illustrated at 8 in the machine frame 2, 3. These devices are in the form of ducts, tubing, pumps for suction, and discharge members which are used for powering the cutters and removing excavated detritus. Such devices are well known in the excavator art and need not be illustrated or described further here.

Figure 2:
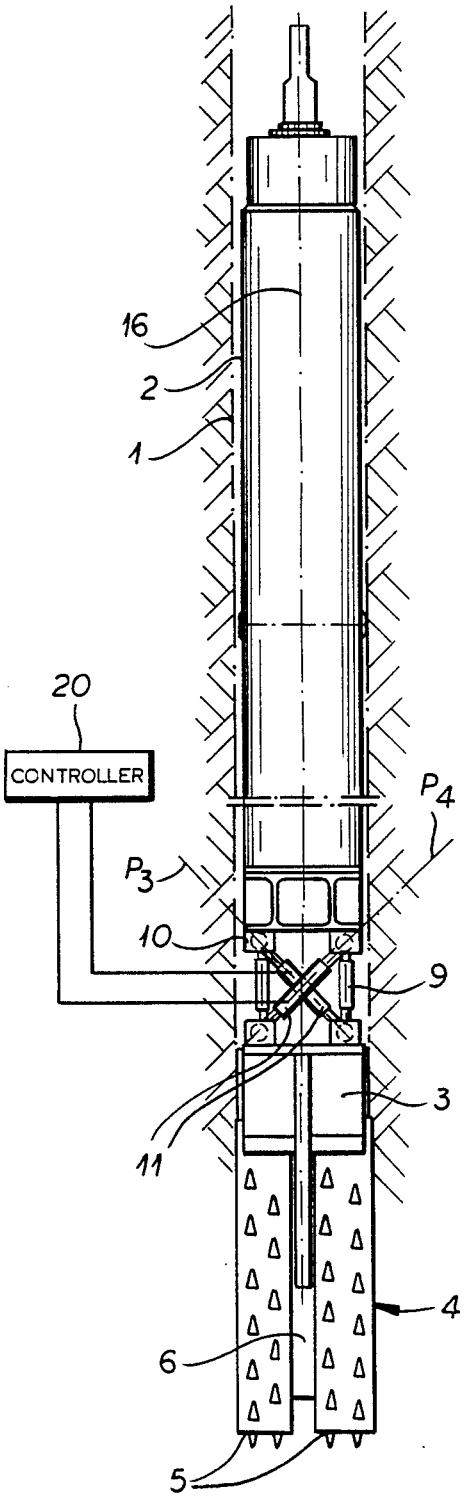
FIG. 2 is a side elevational view of the apparatus as seen from the left side in the direction of the arrow II in FIG. 1.
Figure 4:
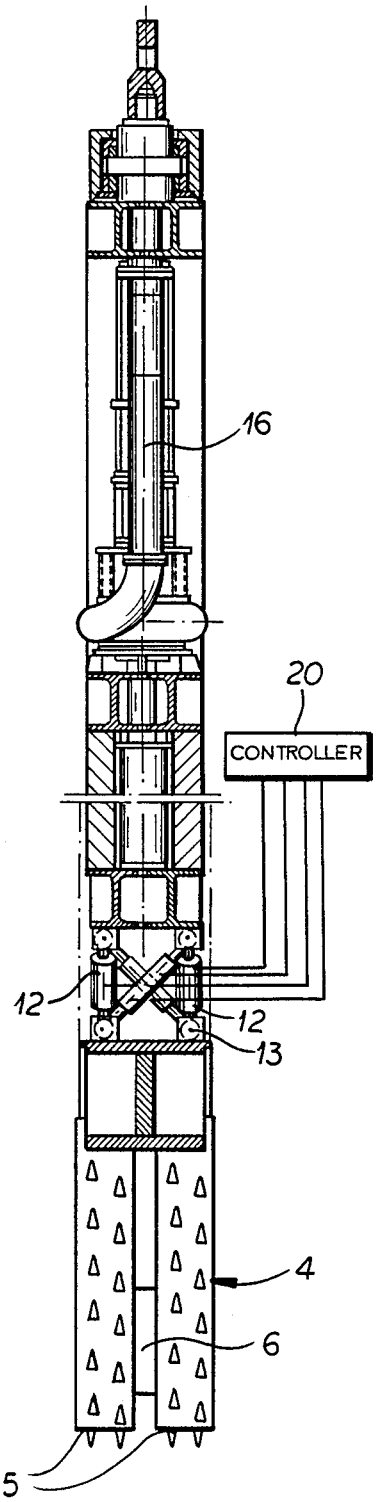
FIG. 4 is a cross sectional view taken along the section line IV—IV of FIG. 1 in the direction of the arrows.
Figure 3:
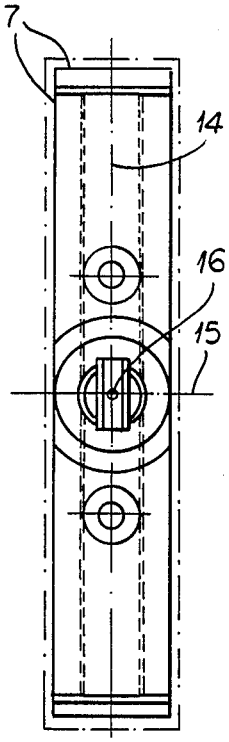
FIG. 3 is a top plan view of the apparatus of FIG. 1.

From FIGS. 1 and 2 it can be seen that the machine frame 2, 3 comprises an upper guide frame 2 and a lower guide frame 3. The cutting wheels 4 are mounted on the lower guide frame 3.

The lower guide frame 3 is suspended with the help of pivot rods 9 and corresponding swivel pivot joints 10 (which can be universal joints) under the upper guide frame 2.

The pivot rods 9 are pressure stable and stable under tension, i.e. after being adjusted as to length are nonextensible or contractable.

For control of the lower guide frame 3 opposite the guide frame 2 within the degrees of freedom provided by the pivot suspension, a controlling piston-and-cylinder unit is provided comprising controlling piston-and-cylinder devices 11,12 mounted between upper guide frame 2 and lower guide frame 3 and supported by ball joints 13 in upper guide frame 2 and lower guide frame 3.

It is understood that the controlling piston-and-cylinder unit and the entire pivot region can be protected by a flexible sleeve or the like from dirt.

In the embodiment shown, the pivot rods 9 are located in the vicinity of the corners of the machine frame 2, 3.

The controlling piston-and-cylinder unit comprises four pairs of controlling piston-and-cylinder devices 11, 12 operated by a controller 20.

The devices are oriented in four inclined planes $P_1$, $P_2$, $P_3$, and $P_4$. Consequently the lower guide frame 3 opposing the upper guide frame 2 has two degrees of freedom for pivotal motion about the axes 14, 15 of the cross section. Frame 3 is moreover pivotable and rotatable about a vertical axis 16.

The illustrated number of pivot rods 9 and controlling piston-and-cylinder devices 11,12 is above the minimum number which is required for coupling two bodies. From an engineering standpoint this multiple support is significant, particularly because of the high load borne by the apparatus.

The cutting wheels 4 can be equipped with various different digging tools. Also the axial support and the rotation direction of the cutting wheels can be adjusted to the prevalent conditions.

I claim:

1. An apparatus for excavating a slot, comprising:

an upper member of generally vertically elongated horizontally narrow rectangular parallelopipedal configuration adapted to be lowered into the ground;

a lower member of rectangular parallelopipedal configuration with a horizontal cross section corresponding to that of said upper member and spaced directly below said upper member;

a plurality of substantially inextensible links connecting said upper member with said lower member and being swivably joined at the ends of said links with said members to permit angular displacement of said lower member relative to said upper member about a vertical axis of said members, and two substantially horizontal mutually perpendicular axes corresponding to longitudinal and transverse axes of said cross section, said vertical axis and said longitudinal axis defining a longitudinal median plane through said members, said vertical axis and said transverse axis defining a transverse median plane through said members;

at least two hydraulic piston-and-cylinder units symmetrically inclined to said transverse median plane and connected to ball joints to said upper and lower members;

at least two pairs of hydraulic piston-and-cylinder units disposed symmetrically on opposite sides of said transverse median plane but symmetrically inclined to said longitudinal median plane and connected by ball joints to said upper and lower members;

means for controlling said piston-and-cylinder units to control displacement of said lower member about said axes;

at least one cutting wheel on said lower member drivable to cut said slot into the ground; and wherein four of said inextensible links are provided at respective corners of the horizontal cross section through said apparatus.

2. The excavator defined in claim 1 wherein said piston-and-cylinder units symmetrically inclined to said transverse median plane are provided in respective pairs.

* * * * *